United States Patent [19]

Manaka et al.

[11] Patent Number: 4,907,558

[45] Date of Patent: Mar. 13, 1990

[54] ENGINE CONTROL APPARATUS

[75] Inventors: Toshio Manaka, Katsuta; Masami Shida, Mito, both of Japan

[73] Assignee: Hitachi, Ltd., Tokyo, Japan

[21] Appl. No.: 192,546

[22] Filed: May 11, 1988

[30] Foreign Application Priority Data

May 15, 1987 [JP] Japan ..... 62-116834

[51] Int. Cl.[4] ..... F02D 41/10; F02D 41/12; F02D 41/14

[52] U.S. Cl. ..... 123/489; 123/492; 123/493

[58] Field of Search ..... 123/489, 492, 493, 478, 123/480

[56] References Cited

U.S. PATENT DOCUMENTS 4,416,237 11/1983 Aoki et al. ..... 123/438
4,615,319 10/1986 Tomisawa ..... 123/440
4,667,631 5/1987 Kinugasa ..... 123/492 X
4,712,529 12/1987 Terasaka et al. ..... 123/492
4,723,524 2/1988 Atago et al. ..... 123/492
4,729,362 3/1988 Mori ..... 123/492
4,741,311 5/1988 Nakajima et al. ..... 123/492 X
4,741,312 5/1988 Ohishi ..... 123/489
4,771,753 9/1988 Ohishi ..... 123/440 X
4,788,958 12/1988 Nakajima et al. ..... 123/489
4,805,579 2/1989 Tashimitsu et al. ..... 123/492

*Primary Examiner*—Tony M. Argenbright
*Attorney, Agent, or Firm*—Antonelli, Terry & Wands

[57] ABSTRACT

An internal combustion engine control apparatus in which upon detection of transient state of the engine such as acceleration, deceleration or the like, the amount of fuel supply to the engine is corrected by using transient correcting coefficients which are determined previously and updated through learning procedure. The correcting coefficient is updated on the basis of the result of comparison of the air-fuel ratio detected upon occurrance of the transient state with a predetermined reference value.

12 Claims, 10 Drawing Sheets

FIG. 7

| N \ ΔQa | ~ΔQ0 | ~ΔQ1 | ΔQ1~ |
|---|---|---|---|
| ~N0 | K00 | K01 | K02 |
| ~N1 | K10 | K11 | K12 |
| N1~ | K20 | K21 | K22 |

FIG. 8

| N \ ΔQa | ~ΔQ0 | ~ΔQ1 | ΔQ1~ |
|---|---|---|---|
| ~N0 | J00 | J01 | J02 |
| ~N1 | J10 | J11 | J12 |
| N1~ | J20 | J21 | J22 |

FIG. 9

| N \ ΔQa | ~ΔQ0 | ~ΔQ1 | ΔQ1~ |
|---|---|---|---|
| ~N0 | L00 | L01 | L02 |
| ~N1 | L10 | L11 | L12 |
| N1~ | L20 | L21 | L22 |

FIG. 10

| $A/F_{MAX}$ | $\Delta A/F_0$ | $\Delta A/F_1$ | $\Delta A/F_2$ |
|---|---|---|---|
| $\alpha_n$ | $\alpha_0$ | $\alpha_1$ | $\alpha_2$ |

FIG. 11

| N \ ΔQa | ~ΔQ0 | ~ΔQ1 | ΔQ1 |
|---|---|---|---|
| ~N0 | M00 | M01 | M02 |
| ~N1 | M10 | M11 | M12 |
| N1~ | M20 | M21 | M22 |

FIG. 12

| $A/F_{MDO}$ | $\Delta A/F_0$ | $\Delta A/F_1$ | $\Delta A/F_2$ |
|---|---|---|---|
| $\beta_n$ | $\beta_0$ | $\beta_1$ | $\beta_2$ |

OUTPUT OF THROTTLE SENSOR

THV

OUTPUT OF $O_2$-SENSOR

OL

OUTPUT OF A/F SENSOR

A/F

OUTPUT OF AIR FLOW SENSOR $Q_a$

ESTIMATED INTAKE AIR QUANTITY $Q'_a$

INJECTION PULSE WIDTH $T_i$

SIMULTANEOUS INJECTION

SEQUENTIAL INJECTION

ENGINE CONTROL APPARATUS

BACKGROUND OF THE INVENTION

The present invention relates in general to a control apparatus for an internal combustion engine and more particularly to an engine control apparatus capable of enhancing controllability of air-fuel ratio in the transient states of the engine operation such as acceleration and deceleration.

In the prior art control apparatus for the internal combustion engine which is based on the air-fuel ratio feedback control, it is known that correction of control parameters upon occurrence of the transient state is performed by learning procedure, as is disclosed in Japanese Patent Application Laid-Open No. 143136/1982 (JP-A-57-143136). However, the known control apparatus suffers from the problem that correction of the control parameters in the transient state of the engine operation based on the learning is poor in accuracy because no due consideration is paid to the fact that the air-fuel ratio is deviated considerably from the desired value upon occurrence of the transient state.

SUMMARY OF THE INVENTION

An object of the present invention is therefore to provide an engine control apparatus which can assure optimum engine control by enhancing the accuracy of the control parameters corrected by learning in the transient state of engine operation.

In view of the above object, there is provided according to a general aspect of the present invention an engine control apparatus which is provided with comparison means for comparing the actual air-fuel ratio with a desired one within a predetermined time in succession to the detection of the transient state, and updating means for updating a transient correcting value based on the learning (hereinafter referred to as the learned transient correcting value) on the basis of the result of the abovementioned comparison.

By virtue of provision of the comparison means and the updating means, fuel supply is so performed that difference between the amount of fuel supply (injection) determined arithmetically and the actual fuel supply (injection) can be compensated for, whereby fluctuation of the air-fuel ratio in the transient state can be suppressed in a satisfactory manner.

BRIEF DESCRIPTION OF THE DRAWINGS

FIG. 7 is a view showing a map (table) of learned transient correcting values for the acceleration transient taking place starting from the fuel-uncut state;

FIG. 8 is a view showing a map or table of learned transient values for the acceleration taking place starting from the fuel-cut state;

FIG. 9 is a view showing a map or table of learned transient values for the deceleration;

FIG. 10 is a view showing a map of learned transient value correcting coefficient;

FIG. 11 is a view showing a table of learned transient values looked up upon instantaneous fuel injection;

FIG. 12 is a showing a table of learned transient value correcting coefficients in correspondence with deviations of the air-fuel ratio from a reference value thereof;

DESCRIPTION OF THE PREFERRED EMBODIMENTS

Now, the present invention will be described in detail in conjunction with exemplary embodiments by reference to the drawings.

Figure 1:
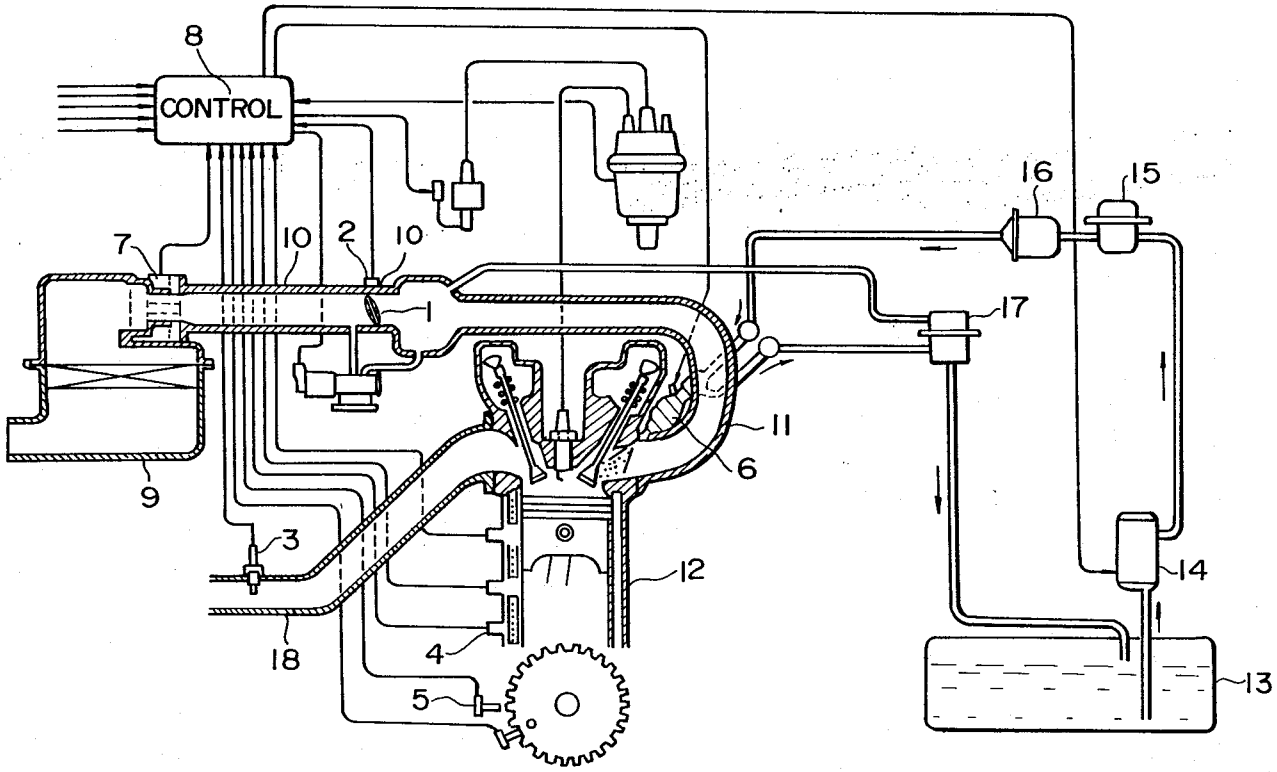
FIG. 1 is a schematic view showing a structure of an internal combustion engine to which the present invention is applied.

FIG. 1 shows schematically a structure of an internal combustion engine provided with a fuel injection system to which the present invention is applied. Referring to the figure, he air entering an air cleaner 9 through an inlet port thereof is introduced to an air intake pipe 11 by way of a duct 10 equipped with an air flow sensor 7 for detecting the intake air flow and a throttle body 5 having a throttle valve 1 for controlling the amount of air to be sucked into engine cylinders of an internal combustion engine 12. A throttle sensor 2 is provided for detecting the degree of opening of the throttle valve 1 incorporated in the throttle body 5. On the other hand, fuel contained in a fuel tank 13 and sucked and pressurized by a fuel pump 14 is introduced to injectors 6 mounted on the air intake pipe 11 after having passed through a fuel damper 15 and a fuel filter 16, whereby the fuel is injected into the internal combustion engine 12 through the injectors 6. A fuel regulator 17 is provided in association with the fuel supply system for regulating the fuel pressure so that the fuel injection through the injector 6 is maintained to be constant. A rotation sensor 5 is provided in combination with a crank shaft of the engine 12 to produce an output signal from which a reference signal for controlling the fuel injection timing and a signal representative of the engine speed (number of revolutions) are derived. A mixture gas sucked into the engine cylinder 12 undergoes compression and combustion. Combustion energy thus generated is converted into kinetic energy for rotating the crank shaft of the engine. Exhaust gas resulting from the combustion is discharged to the atmosphere through an exhaust pipe 18 which is provided with an air-fuel ratio sensor 3 for detecting the air-fuel ratio of the exhaust gas. Further, the engine is equipped with a water temperature sensor 4 for detecting the temperature behavior of the engine. The output signals of the various sensors are supplied to a control unit 8 to be processed for controlling the engine operation by driving correspondingly the associated actuators in accordance with the output signals resulting from the processing, as will be described hereinafter in more detail.

Figure 2:
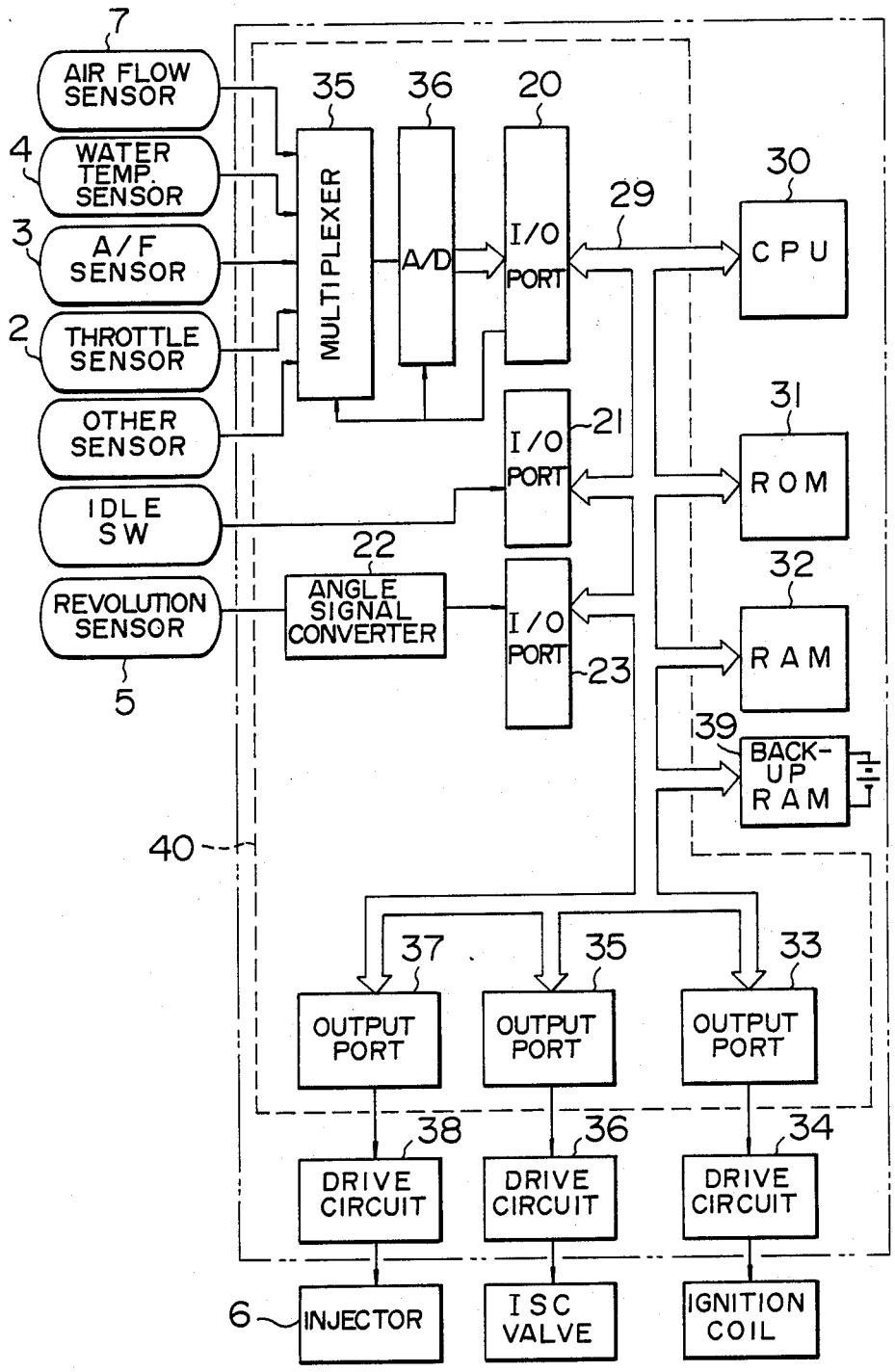
FIG. 2 is a block diagram showing a general arrangement of an engine control apparatus according to an embodiment of the present invention.

FIG. 2 shows in a block diagram an arrangement of the control unit 8. Referring to the figure, the control unit 8 includes a central processing unit (hereinafter referred to as CPU in abbreviation) 30, a read-only memory (referred to as ROM) 31, a random access memory (RAM) 32, an input/output (I/O) circuit 40 and an erasable random access memory or RAM 39 provided with a back-up power supply source, wherein these components are interconnected by a bus line 29. The I/O circuit 40 serves to input the signals outputted from the various sensors to the CPU 30 and control the associated actuator driver circuits in accordance with the output signals of the CPU 30. The output signals of the various sensors such as the air flow sensor 7 and others are selectively fetched through a multiplexer 35 constituting a part of the I/O circuit 40 to be supplied to the CPU 30 by way of an input port 20 after having undergone analogue-to-digital (A/D) conversion by an A/D converter 36. The output signal of the rotation sensor 5 is supplied to the CPU 30 though an angular signal conversion circuitry 22 of the I/O circuit 40 and an input port 21. The CPU 30 performs arithmetic operations on the data supplied from the I/O circuit 40 in accordance with a program stored in the ROM 31 and delivers the signals for controlling the injectors 6 and others to the I/O circuit 40. The RAM 32 as well as the backed-up RAM 39 serves for storing temporarily tose data which are involved in the arithmetic processing performed by the CPU 30. The data signals outputted from the CPU 30 are converted into pulse signals by output ports 33, 35 and 37 of the I/O circuit 40 to be supplied to the drive circuits 34, 36 and 38 for controlling the ignition coil, ISC valve and injectors 6 through the respective actuators.

Figure 13A:
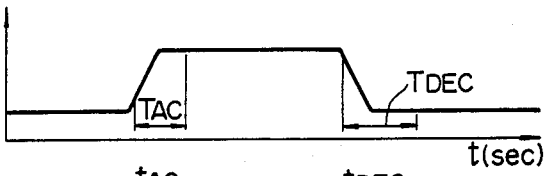
FIGS. 13A to 13F are views for graphically illustrating behaviors of throttle opening, $0_2$-sensor output, air-fuel ratio sensor output, air-flow sensor output, intake air flow compensated for in respect to delay, and injection pulse width upon occurrence of acceleration and deceleration transients, respectively.
Figure 13B:
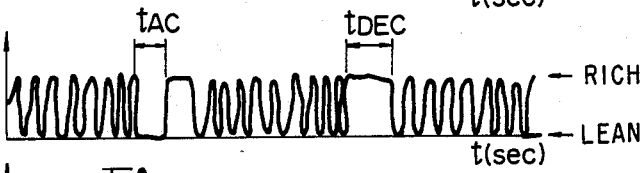

FIGS. 13A to 13F are views for graphically illustrating engine operation in the acceleration and deceleration transient states. When a driver depresses an accelerator pedal with the intention of accelerating the engine speed, the opening of the throttle valve 1 is increased, resulting in the amount of intake air being increased. Correspondingly, the amount of fuel supply is also increased. In this connection, it is noted that the intake air is low in mass when compared with the fuel. Accordingly, the air is introduced into the engine cylinders rapidly without any appreciable delay in response to the opening of the throttle valve 1, while a time lag will intervene to a certain extent in the injection of fuel into the engine cylinders through the injectors because of the relatively large mass of the fuel. Besides, deposition or adhesion of the fuel on the inner wall of fuel transportation pipe also partakes in delaying the fuel injection in an intricate manner. Such being the circumstances, the amount of fuel supply to the engine cylinder can not follow instantaneously the increasing amount of intake air in response to the increasing throttle opening THV. Such a situation is graphically illustrated in FIG. 13A. As the result of this, the amount of intake air becomes temporarily excessive, leading to prevalence of the lean state. Consequently, the output signal OL of the $O_2$-sensor assumes a lean level for a certain period, as is illustrated in FIG. 13B. In the case of the system in which the air-fuel ratio sensor 3 is employed, the output of this sensor assumes a considerably higher level than the theoretical air-fuel ratio for a certain time duration, as will be seen in FIG. 13C.

FIGS. 15 to 18 are views for illustrating in flow charts the operation of the CPU 30 (FIG. 2) according to the teaching of the invention.

Figure 14A:
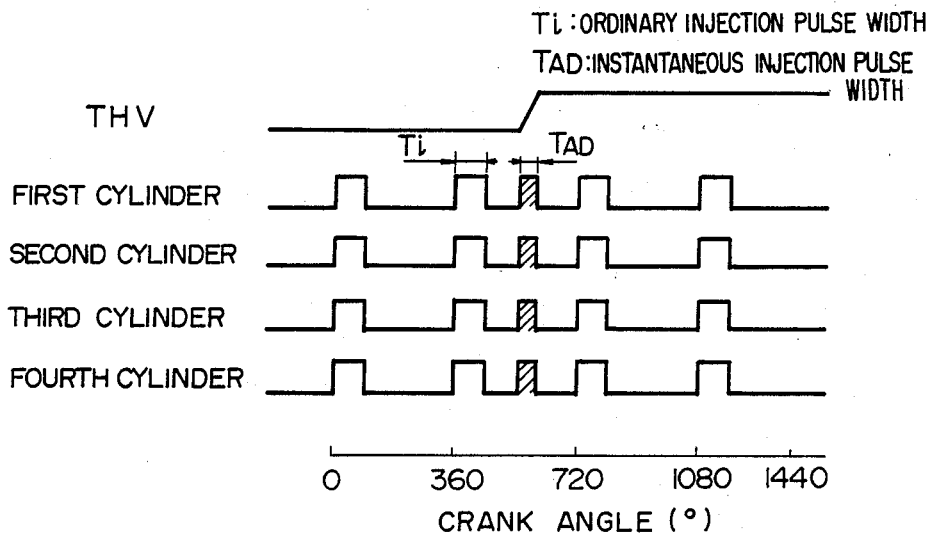
FIGS. 14A and 14B are waveform diagrams showing fuel injection pulses in a simultaneous injection system and a sequential injection system, respectively.
Figure 14B:
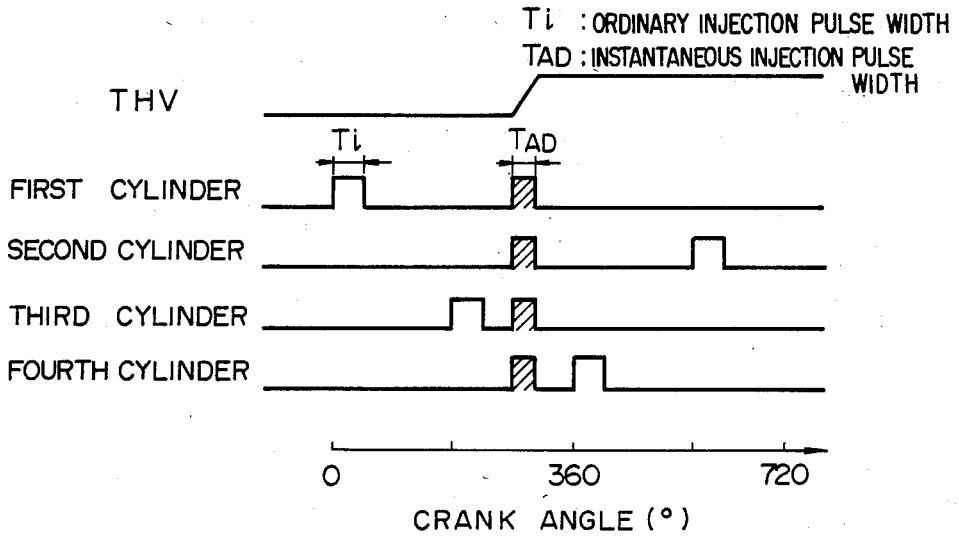
Figure 15:
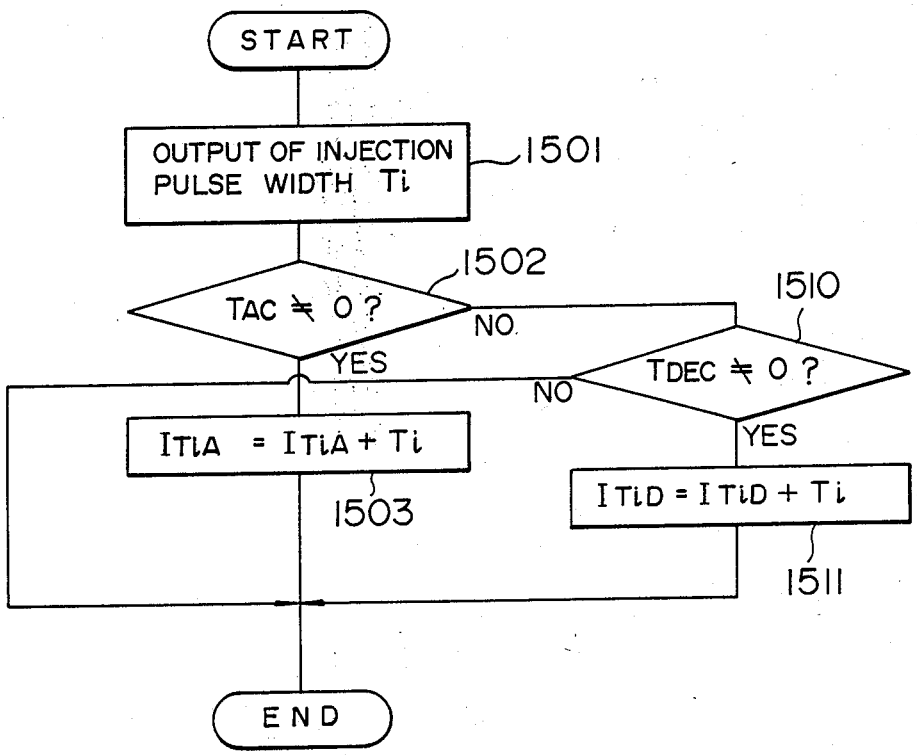
FIGS. 15, 16, 17 and 18 are views for illustrating in flow charts operations of the control apparatus according to an embodiment of the present invention.
Figure 16:
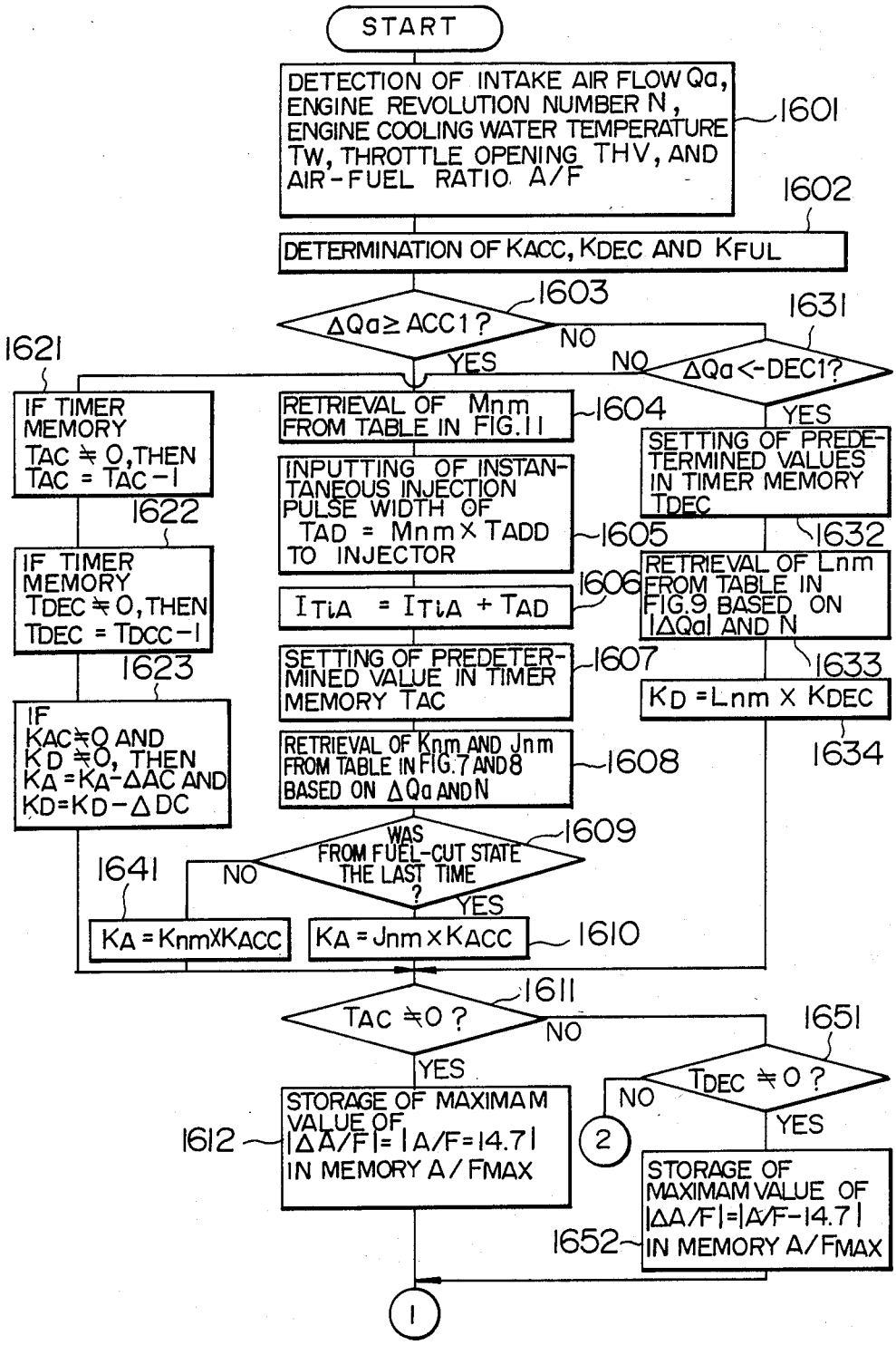
Figure 17:
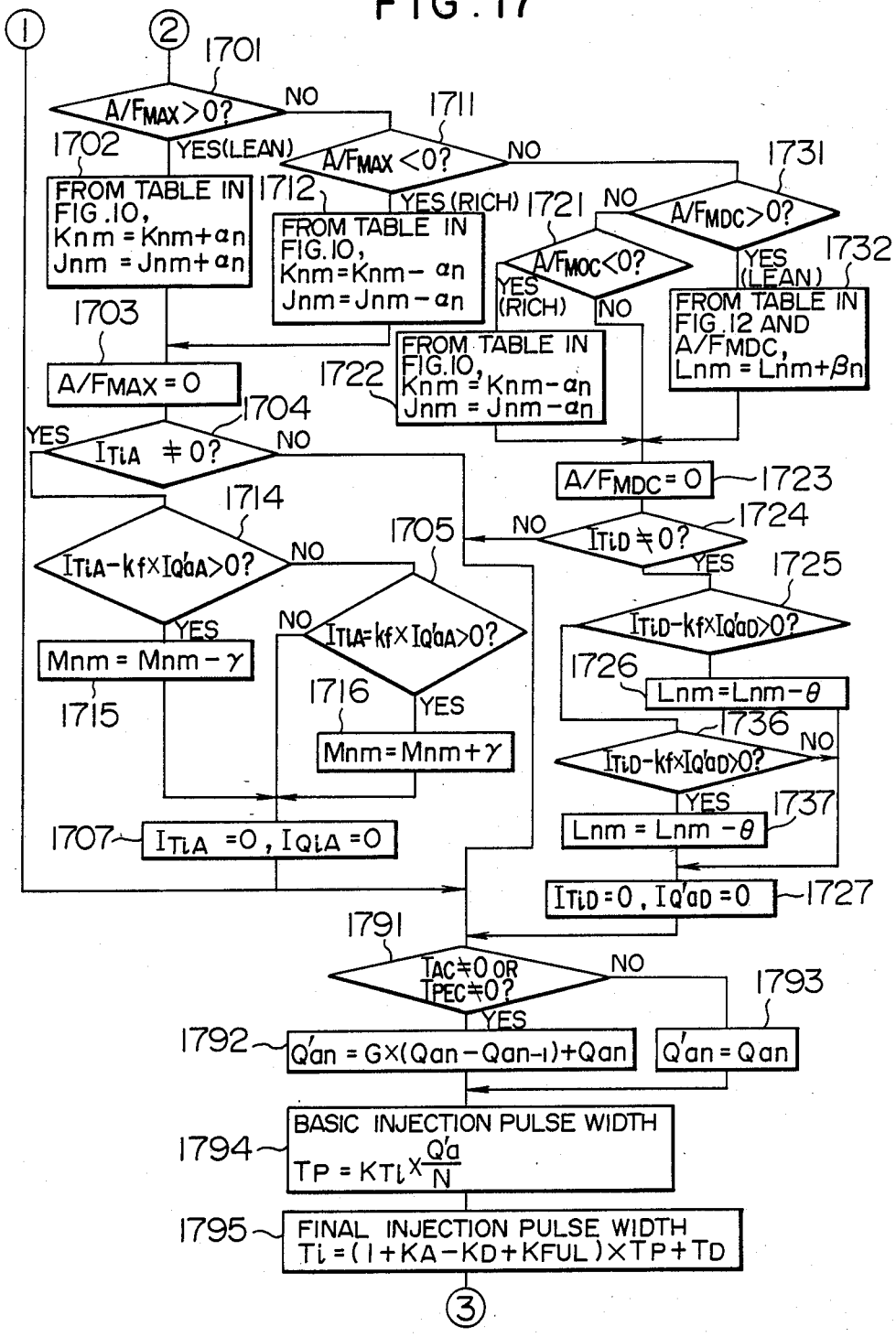

More specifically, FIG. 15 is a flow chart for illustrating the arithmetic operation for determining the injection pulse width. Activation of the program shown in FIG. 15 is triggered at a time point corresponding to an angle at which the fuel injection normally takes place. By way of example, in the case of the simultaneous injection system illustrated FIG. 14A, the program is activated at every crank angle of 360°, while in the sequential injection system illustrated in FIG. 14B, the program is activated at every crank angle of 180°. Referring to FIG. 15, the injection pulse of the duration or width $T_i$ determined through the arithmetic processing described hereinafter in conjunction with the flow charts shown in FIGS. 16 and 17 is outputted from a register incorporated in the RAM 32 (FIG. 2) at a step 1501. Subsequently, at a step 1502, decision is made as to whether a counter value $T_{AC}$ to be utilized in temporal calculation involved in the acceleration transient processing described hereinafter is zero or not. Unless the counter value $T_{AC}$ is zero, the integrated value $I_{TiA}$ of the injection pulse width integrated up to the last injection pulse is added with the injection pulse width $T_i$ outputted at the instant time point, whereby the integrated injection pulse width value $I_{TiA}$ is updated at the step 1503. The program then comes to an end. On the other hand, when it is decided at the step 1502 that the counter value $T_{AC}$ is zero, this means that the processing is not validated in response to the detection of occurrence of the acceleration transient. Consequently, the program proceeds to a step 1510 where it is decided whether a counter value $T_{DEC}$ destined for use in the temporal calculation involved in the deceleration transient processing described hereinafter is zero or not. Unless the counter value $T_{DEC}$ is zero, the integrated value $I_{TiD}$ of the injection pulse width is updated at a step 1511, whereupon the program comes to an end. In case the counter value $T_{AC}$ is found to be zero at the step 1502 with the counter value $T_{DEC}$ being also zero at the step 1510, the program comes to an end without updating the integrated pulse width values.

Figure 18:
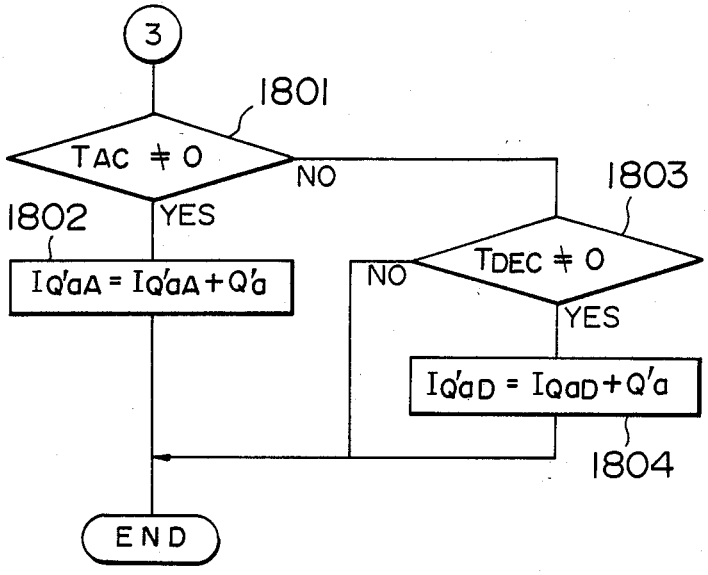

FIGS. 16 to 18 are views for illustrating in flow charts the learning or acquisition of the transient correcting values, arithmetic determination of the instantaneous injection pulse duration or width $T_{AD}$ after detection of the acceleration transient and arithmetic determination of the ordinary injection pulse width $T_i$.

Figure 5:
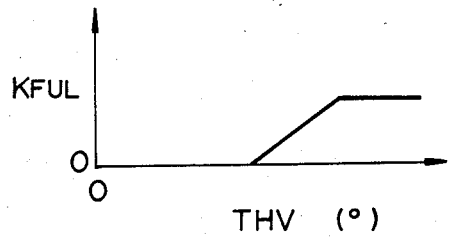
FIG. 5 is a view for graphically illustrating a relation between a fuel increasing coefficient for the fully-opened throttle and the opening degree of a throttle valve.

In contrast to the program for the integrating operation of the injection pulse width shown in FIG. 5 which is triggered at every predetermined crank rotation angle as described above, operation illustrated in the flow charts of FIGS. 16 to 18 is activated periodically at every predetermined constant time interval. By way of example, it may be activated periodically at every time interval of 10 msec.

Figure 3:
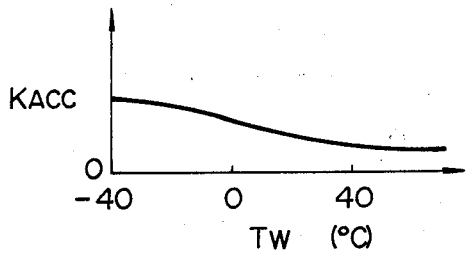
FIG. 3 is a view for illustrating graphically a relation between an acceleration-related fuel increasing coefficient and temperature of engine cooling water.
Figure 4:
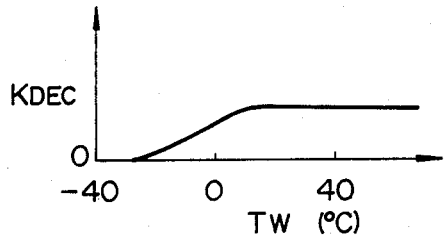
FIG. 4 is a view for graphically illustrating a relation between a deceleration-related fuel decreasing coefficient and the engine cooling water temperature.

Referring first to FIG. 16, outputs of the various sensors such as the air flow sensor 7, the engine cooling water temperature sensor 4, the throttle opening sensor 2 and others are fetched at a step 1601, being followed by a step 1602 where an acceleration fuel increasing coefficient $K_{ACC}$ and a deceleration fuel decreasing coefficient $K_{DEC}$ are determined on the basis of the engine cooling water temperature $T_W$. These coefficients are definitely determined from the coolant water temperature $T_W$. To this end, relations between the coefficients $K_{ACC}$ and $K_{DEC}$ and the coolant water temperature $T_W$ such as illustrated in FIGS. 3 and 4, respectively, may be previously stored in the ROM 31 for thereby allow the coefficients $K_{ACC}$ and $K_{DEC}$ to be definitely determined through simple look-up procedure. Although these coefficients are assumed to be determined as a function of the coolant water temperature $T_W$ in the case of the illustrative embodiment, it should be understood that the coefficients which depend on other engine parameter(s) or remain at fixed values may also be employed to substantially similar effects. At a step 1602, a full-open fuel increasing coefficient $K_{FUL}$ is also determined on the basis of the opening THV of the throttle valve 1 as detected by the throttle sensor 2. Also in this case, relation between the throttle opening THV and the coefficient $K_{FUL}$ may be previously determined such that the amount of fuel injection is increased as a function of the increasing in the throttle opening THV, as is illustrated in FIG. 5, and stored in the ROM 31 to thereby allow the coefficient $K_{FUL}$ to be determined simply through the look-up procedure. At a step 1603, it is decided whether acceleration takes place or not. To this end, a difference $\Delta Q_a$ between the air flow $Q_{an-1}$ detected by the air flow sensor 7 at the preceding sampling time point and the air flow $Q_{an}$ detected at the instant sampling time point is determined to be subsequently compared with a constant ACCl. Although the intake air quantity is used in making decision as to the occurrence of acceleration in the case of the illustrative embodiment, it should be understood that other engine load parameter such as the injection pulse width $T_i$, the throttle opening THV or the like may be equally employed. At steps 1604 to 1610 which are executed in succession to the decision step 1603 when the acceleration transient is detected (i.e. when $\Delta Q_a \geqq ACCl$), initial values of the various variables employed in the arithmetic determination of the instantaneous injection pulse width and the updating of the learned correction coefficient are set. More specifically, at the step 1604, the learned correcting coefficient for the instantaneous injection is determined. To this end, a table containing relations such as shown in FIG. 11 may be previously stored in the erasable memory for allowing the coefficient of concern to be determined simply through look-up of the table. In the case of the illustrative embodiment, the RAM 39 with back-up power source is used as the erasable memory. At the step 1605, the instantaneous injection pulse width $T_{AD}$ is arithmetically determined. The instantaneous injection pulse width $T_{AD}$ is determined by multiplying a basic instantaneous injection pulse width $T_{ADD}$ with a correcting value $M_{nm}$. The basic instantaneous injection pulse width $T_{ADD}$ may be a fixed value determined adaptively to the engine system of concern. Besides, it may also be determined on the basis of a parameter representative of the engine operating state.

Figure 6:
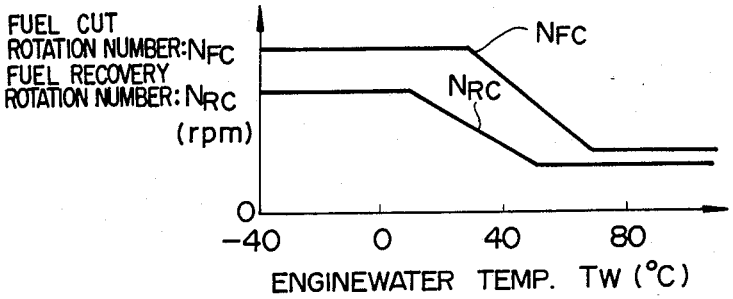
FIG. 6 is a view for illustrating graphically relations between an engine cooling water temperature on one hand and a fuel cut rotation number when the throttle is fully opened and a fuel recovery rotation number on the other hand, respectively.
Figure 13C:
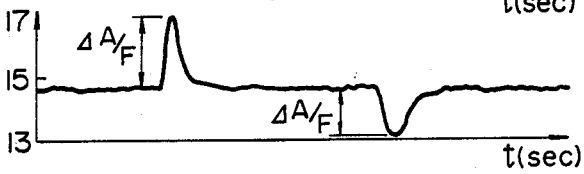
Figure 13D:
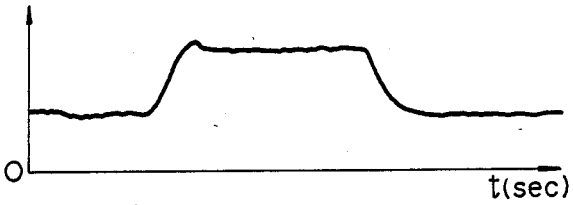

The ordinary fuel injection is performed at every predetermined crank angle. By way of example, in the case of the simultaneous injection system, the fuel injection takes place in such a manner as illustrated in FIG. 14A, while in the case of the sequential injection system, the fuel injection is effectuated in the manner shown in FIG. 14B. However, when the throttle valve 1 is opened, resulting in that the amount $Q_a$ of intake air is increased abruptly, being accompanied with steep increasing in the output signal THV of the throttle sensor, then the fuel supply will become inadequate with the ordinary periodical fuel injection at the predetermined rotation angle as mentioned above, necessitating the instantaneous fuel injection which is realized in the manner as indicated by hatched pulses in FIGS. 14A and 14B. At the step 1606, integration of the injection pulse width is performed. As described hereinbefore, the program shown in FIG. 15 is activated at every predetermined crank angle at which the ordinary fuel injection takes place, to thereby perform the integration of the fuel injection pulse width. In contrast, the instantaneous injection is performed irregularly independent of the activation of the program shown in FIG. 15. In other words, the integration of the instantaneous injection pulse width is performed by a program activated upon or in succession to the detection of the acceleration transient. At the step 107, a predetermined value is placed in a timer memory $T_{AC}$. The timer memory $T_{AC}$ is set as shown in FIG. 13A and utilized in arithmetic determination of an estimated amount $Q_a'$ of the intake air and the integration of the injection pulse width $T_i$ shown in FIGS. 13E and 13F, respectively, which are performed within a predetermined time after detection of the acceleration transient. The waveform $Q_a$ represents the output signal of the air flow sensor which varies in a manner as illustrated in FIG. 13D. However, since the output of the air flow sensor is delayed relative to the actual change in the intake air flow, it is desirable to use the estimated air flow value $Q_a'$, as described hereinafter. Although the detection of the intake air flow is realized by using an air flow sensor in the case of the illustrative embodiment, it should be understood that other measuring means such as engine rotation angle sensor may be equally employed. At the step 1608, a learned transient value $K_{nm}$ for the acceleration from the state in which the fuel supply is not cut (fuel-uncut state) as well as a learned transient value $J_{nm}$ for the acceleration from the state in the fuel supply is cut (fuel-cut state) is detected. When the throttle is fully closed, the fuel supply is cut only when predetermined conditions are met with a view to improving fuel-cost performance and exhaust gas characteristics. For example, FIG. 6 shows characteristic curves of the fuel cut rotation number $N_{FC}$ and the fuel recovery rotation number $N_{RC}$ as a function of the water temperature $T_W$ in the state in which the throttle valve is completely closed. When the actual engine rotation number N is not smaller than $N_{FC}$ in the completely closed state of the throttle valve, occurrence of the deceleration transient is determined to thereby cut the fuel supply. When the fuel supply is cut, the fuel deposited on the wall of the fuel transportation pipe is sucked into the engine cylinders. Upon restoration from the fuel-cut state, a part of fuel as supplied is consumed to form deposition or adhesion on the wall of the fuel transportation pipe. Accordingly, two learned transient values $K_{nm}$ and $J_{nm}$ are used for the case where the acceleration takes place from the fuelcut state on one hand and the case where the acceleration takes place from the fuel-uncut state on the other hand, respectively. The learned transient values $K_{nm}$ and $J_{nm}$ for the acceleration transient are held in the memory device of the engine control unit 8 in the form of maps or tables in correspondence relation to the engine revolution number N and the change $\Delta Q_a$ in the intake air flow, as is shown in FIGS. 7 and 8, respectively. It should however be understood that these learned values $K_{nm}$ and $J_{nm}$ may be held in combination with other parameters indicating the engine states. More specifically, the learned values are held in the erasable memory such as the power backed-up RAM 37 shown in FIG. 2 so as to be rewritten at appropriate time points in the course of execution of the program. At steps 1610 and 1641, the accelerationrelated fuel increasing coefficient $K_{ACC}$ is multiplied with the learned values $K_{nm}$ and $J_{nm}$ to thereby determine the final acceleration-related fuel increasing coefficients $K_A$, respectively.

The steps 1631 to 1634 are executed for setting the initial values and determining the correcting coefficients when the deceleration transient is detected.

When decision is made at the step 1603 that the transient is not acceleration, being followed by the decision at the step 1631 that the change $\Delta Q_a$ in the intake air flow (quantity) is smaller than a preset value, then the occurrence of deceleration transient is decided. At the step 1632, a predetermined value is placed in the timer memory $T_{DEC}$. At the step 1633, the learned transient value for the deceleration is searched. The learned transient values may be stored in the erasable memory 37 of the engine control unit 8 in correspondence with the intake air flow change $\Delta Q_a$ as shown in FIG. 9, by way of example, and the engine rotation number N so as to be read out straightforwardly. At the step 1634, the final deceleration-related fuel decrease correcting coefficient $K_D$ is determined.

The steps 1621 to 1623 are executed within a predetermined time from the occurrence of deceleration or acceleration transient.

Now, it is assumed that neither decision of acceleration is made at the step 1603 nor decision of deceleration is made at the step 1631. In that case, it is decided at a step 1621 if the timer memory $T_{AC}$ is zero or not. Unless $T_{AC}$ is zero, the content of the timer memory $T4_{AC}$ is decremented by one, since time lapse from the occurrence of the acceleration transient falls within the predetermined range, as illustrated in FIG. 13C. Similarly, at a step 1622, it is decided if the content of the timer memory $T_{DEC}$ used for the deceleration transient processing is zero and the timer memory value is decremented by one unless $T_{DEC}$ is zero. At a step 1623, the coefficient $K_A$ determined at the steps 1610 and 1641 or the coefficient $K_D$ determined at the step 1634 are, respectively, decremented by $\Delta AC$ or $\Delta DC$ progressively starting from the time point at which the acceleration or deceleration is detected. For coping with the acceleration transient, a sufficiently large amount of fuel supply must be injected to ensure the positive increasing of the engine speed correspondingly. However, when the engine speed is increased up to a certain level in the course of acceleration, such large amount of fuel for injection as that for the beginning of acceleration is no longer required. Accordingly, the value of the final acceleration-related fuel increase correcting coefficient together with the value of the timer memory are decreased progressively. To this end, the coefficient $K_A$ is progressively decremented by the predetermined value $\Delta AC$ periodically upon every activation of program, so long as the coefficient $K_A$ is not zero, as indicated at the step 1623. Similarly, the value of the final deceleration-related fuel decrease correcting coefficient $K_D$ is progressively decremented by the predetermined value $\Delta DC$, so long as the coefficient $K_D$ is not zero.

Routine including steps 1611 and 1612 as well as the routine including steps 1651 and 1652 are provided for storing in the memory the deviation $\Delta A/F$ of the air-fuel ratio sensor output A/F from the desired air-fuel ratio shown in FIG. 13C.

More specifically, at the step 1611, the timer memory $T_{AC}$ destined for use in the acceleration transient processing is zero or not. When not zero, the maximum value of the deviation $\Delta A/F$ from the desired value is stored in a memory $A/F_{MAX}$ (FIG. 10). When the content of the above-mentioned timer memory $T_{AC}$ is found zero at the step 1611, decision is made at the step 1651 as to whether the counter value $T_{DEC}$ destined for use in the deceleration transient processing is zero or not. Unless it is zero, the maximum value of the deviation $\Delta A/F$ is stored in a memory $A/F_{MDC}$ (FIG. 12).

When the timer value is found not zero at the steps 1611 and 1651, estimation of the intake air flow and calculation of the injection pulse width are performed through a routine including a step 1791 and others.

When the memory timer values are found to be zero at the steps 1611 and 1651, updating of the individual learned correcting values are performed through a routine including step 1701 and the rest.

Referring to FIG. 17, steps 1701, 1702, 1711, 1712, 1721, 1722, 1731 and 1732 are provided for updating the learned correcting value in accordance with the value of the maximum deviation $A/F_{MAX}$ of the air-fuel ratio sensor output from the desired air-fuel ratio. More specifically, at the abovementioned steps, the learned transient correcting value $J_{nm}$ for the acceleration transient starting from the fuel-uncut state as well as the learned transient correcting value $K_{nm}$ for the acceleration starting from the fuel-cut state are updated.

At the step 1701, decision is made as to whether the maximum deviation $A/F_{MAX}$ is greater than zero. The greater value of $A/F_{MAX}$ than zero indicates that the amount of fuel injection is small relative to the air intake quantity. Accordingly, the learned value is updated so that the fuel injection pulse width is increased at the step 1702. To this end, values to be added to the maximum deviation $A/F_{MAX}$ are previously determined and stored in the memory. The value $\alpha_n$ to be added which corresponds to the value of the maximum deviation $A/F_{MAX}$ is read out to be added to the learned transient correcting value $J_{nm}$ for the acceleration transient starting from the fuel-uncut state and the learned transient correcting value $K_{nm}$ for the acceleration starting from the fuel-cut state, respectively, to thereby update these learned values. At the step 1703, the value of $A/F_{MAX}$ is cleared for allowing the succeeding arithmetic operation. When the decision made at the step 1711 results in that the value of $A/F_{MAX}$ is smaller than zero, this means that the amount of fuel supply is large relative to that of the intake air. Accordingly, the correcting values $K_{nm}$ and $J_{nm}$ are decremented by the value $\alpha_n$ corresponding to the maximum deviation $A/F_{MAX}$ to thereby update these correcting values, the updated values being stored in the memory. At the step 1703, the value of $A/F_{MAX}$ is cleared and the program proceeds to the succeeding step.

In the deceleration mode, no numerical value is stored in the $A/F_{MAX}$ table (FIG. 10) at the steps 1611, 1612, 651 and 652. Consequently, the value of $A/F_{MAX}$ is held at zero. Since the result of the decision steps 1701 and 1711 is negative (NO), the program proceeds to the step 1731. The steps 1731, 1721, 1732, 1722 and 1723 are provided for updating the learned correcting value for the deceleration transient. When it is decided at the step 1731 that the maximum deviation value $A/F_{MDC}$ in the deceleration transient is greater than zero, the learned transient correcting value $L_{nm}$ for the deceleration transient is incremented by a predetermined value $\beta_n$ at the step 1732. On the other hand, when the decision at the step 1721 results in that the deviation $A/F_{MDC}$ is smaller than zero, the learned correcting value $L_{nm}$ is decremented by $\beta_n$. In this way, the learned transient correcting value $L_{nm}$ for the deceleration is updated. Thereafter, the value of deviation $A/F_{MDC}$ is cleared at the step 1723, whereupon the program proceeds to the succeeding step.

At the steps 1701, 1711, 1731, 1721 and other associated steps, the learned transient correcting values are updated on the basis of the deviation of the air-fuel detected by the air-fuel ratio sensor from the desired A/F value. It should however be appreciated that the output signal of another sensor may be equally utilized for this purpose. By way of example, the learned correcting value may also be updated on the basis of a lean time duration $t_{AC}$ and a rich time duration $t_{DEC}$ derived from the output signal $O_L$ from the $0_2$-sensor, as shown in FIG. 13B.

Figure 13E:
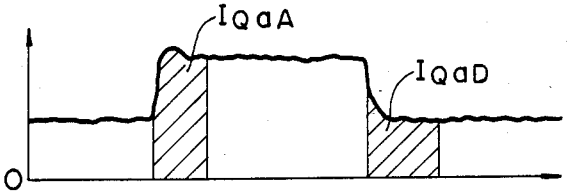
Figure 13F:
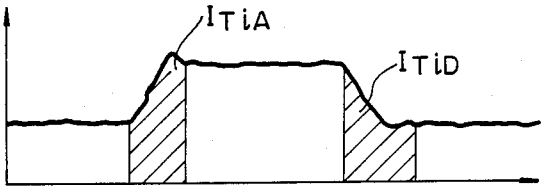

Steps 1704, 1705, 1706, 1707, 1714 and 1715 and steps 1724, 1725, 1726, 1736, 1737 and 1727 are provided for updating the learned correcting value on the basis of the integrated value $I_{Q'a}$ of the intake air flow $Q'_A$ and the integrated value $I_{Ti}$ of the injection pulse width $T_i$ shown in FIGS. 13E and 14, respectively.

When it is decided at the steps 1701 and 1711 that the numerical value is set at the $A/F_{MAX}$ table and when the acceleration transient is detected, decision is then made at the step 1704 as to whether the integrated value $I_{TiA}$ of the injection pulse width for the acceleration is zero or not. When the result of decision at the step 1704 shows that the integrated value $I_{TiA}$ is zero, execution of the program proceeds to the step 1791 to determine arithmetically the final injection pulse width. Otherwise, unless the integrated value $I_{TiA}$ is zero, the integrated value $I_{TiA}$ of the injection pulse width is compared with the integrated value $I_{Q'a}$ of the intake air quantity or flow. In succession to the detection of acceleration, the integration of the injection pulse width is performed in the routine including the steps 1501 to 1511 (FIG. 15) and the steps 1603 to 1610 (FIG. 16) during the period $T_{AC}$. Further, integration of the estimated intake air flow is performed at steps 1801 to 1804 described hereinafter. The amount of fuel injection is in general equal to the product resulting from multiplication of the desired air-fuel ratio with the intake air flow. At the steps 1714, 1715, 1705 and 1706, the learned correcting value $M_{nm}$ for the instantaneous fuel injection is updated so that the integrated value $I_{TiA}$ of the injection pulse width approaches to a value resulting from multiplication of the integrated value $I_{Q'a}$ of the estimated intake air flow with the desired air-fuel ratio $k_f$. More specifically, at the step 1714, decision is made as to whether the integrated injection pulse width $I_{TiA}$ is smaller than the product resulting from multiplication of the desired air-fuel ratio $k_f$ with the integrated estimated intake air flow $I_{Q'A}$. In other words, it is decided whether the following condition is satisfied or not:

$$I_{TiA} - k_f \times I_{Q'A} > 0 \quad \text{... (1)}$$

When the above condition is met, this means that the amount of fuel supply is large relative to the intake air quantity. Accordingly, at the step 1715, the learned correcting value for the instantaneous injection is updated so that the fuel supply is decreased. More specifically, the correcting value of concern is updated by decrementing the value $M_{nm}$ by a predetermined value $\gamma$.

At the step 1705, decision is made as to whether the integrated injection pulse width $I_{TiA}$ is smaller than the product resulting from multiplication of the desired air-fuel ratio $k_f$ with the integrated estimated air flow $I_{Q'A}$. Namely, it is decided whether the following condition is satisfied:

$$I_{TiA} - k_f \times I_{Q'A} < 0 \quad \text{... (2)}$$

When the condition (2) is satisfied, $M_{nm}$ is added with the predetermined value $\gamma$ at the step 1706 to thereby update the learned correcting value. At the step 1707, the integrated injection pulse width value $I_{TiA}$ and the integrated intake air flow $I_{Q'iA}$ are cleared from allowing the integrated values to be utilized in the subsequent programmed operation, whereupon execution of the program proceeds to a step 1791.

Steps 1725, 1726, 1736, 1737 and 1727 are provided for updating the learned correcting value in case the deceleration transient is detected.

At the steps 1725 and 1726, decision is made as to whether the value resulting from subtraction of the product of the desired air-fuel ratio $k_f$ and the integrated estimated intake air flow $I_{Q'aD}$ from the integrated injection pulse width $I_{TiD}$ is greater or smaller than zero, respectively.

More specifically, at the step 1725, it is decided whether the following condition is satisfied or not:

$$I_{TiD} - k_f \times I_{Q'aD} > 0 \quad (3)$$

At the step 1726, the following decision is made.

$$I_{TiD} - k_f \times I_{Q'aD} < 0 \quad (4)$$

When the decision is made at the step 1724 that the integrated injection pulse width is greater than zero, the learned correcting value $L_{nm}$ for the deceleration transient is decreased by a predetermined value $\theta$ to thereby update correcting value. On the other hand, when it is decided at the step 1736 that the integrated injection pulse width value is smaller, the learned correcting value $L_{nm}$ is added with the predetermined value $\theta$ at the step 1737 to thereby update the correcting value. When the updating of the learned correcting value for the deceleration transient has been completed in this manner, the integrated value $I_{TiO}$ of the injection pulse width and the integrated value $I_{Q'aD}$ of the estimated intake air quantity are cleared for thereby allowing the program for correcting the learned value to be activated at the next time, whereupon the program proceeds to the step 1791.

The steps 1791 to 1795 serve for arithmetic determination of the estimated intake air flow $Q'_{an}$ and final injection pulse width $T_i$.

More specifically, at the step 1791, decision is made as to whether the timer memories $T_{AC}$ and $T_{DEC}$ are zero or not. When both are zero, the measured intake air flow $Q_{an}$ derived from the output of the air flow sensor is used as the estimate intake air flow $Q'_{an}$. When either one of the timer memory $T_{AC}$ or $T_{DEC}$ is not zero, this means that the program for the arithmetic determination of the injection pulse width and the updating of the learned correcting value in succession to the detection of the acceleration or deceleration transient is being executed. Then, estimation of the intake air flow is carried out. More specifically, the estimated air intake flow $Q'_{an}$ is determined by adding to the air flow sensor output $Q_{an}$ at the instant sampling time point a product resulting from multiplication of a coefficient with the value obtained by subtracting the air flow sensor output at the preceding sampling time point from the one at the instant sampling time point. Namely, with mathematical expression, $$Q'_{an}=G\times(Q_{an}-Q_{an-1})+Q_{an} \quad (5)$$

Figure 19:
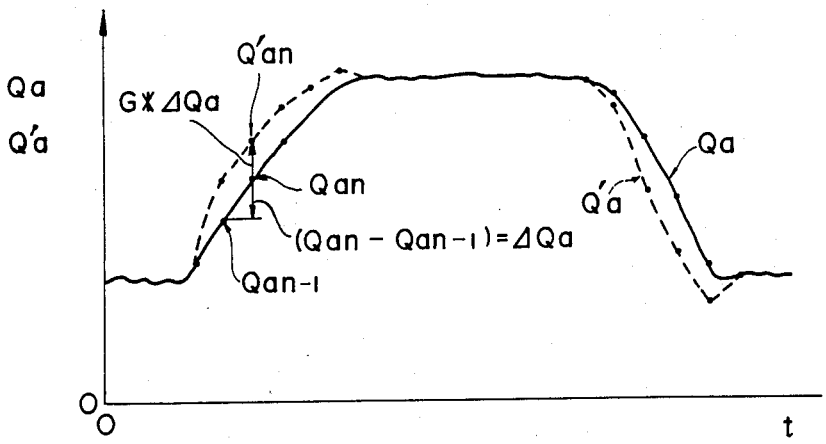
FIG. 19 is a view for illustrating graphically determination of estimated intake air flow.

In the above expression (5), the coefficient G can be determined on the basis of a physical factor of the engine such as, for example, distance between the injector and the engine cylinder. Further, the coefficient G may be a variable determined on the basis of a parameter indicating the engine state such as engine cooling water temperature and others. Estimation of the intake air flow may be carried out in the manner illustrated in FIG. 19, by way of example. At the step 1794, the basic injection pulse width $T_p$ is determined. More specifically, this pulse width $T_p$ is determined by multiplying the estimated amount of intake air per engine revolution with a coefficient $K_{Ti}$ in accordance with the following expression;

$$T_p=K_{Ti}\times(Q'_a/N) \quad (6)$$

The coefficient $K_{Ti}$ is determined on the basis of the engine characteristics or engine state. To this end, a variable parameter representative of the engine state such as, for example, engine load, engine revolution number or the like may be used as the coefficient $K_{Ti}$. Further, a fixed value unique to the engine of concern may be used as the coefficient $K_{Ti}$. At the step 1795, the final injection pulse width $T_i$ is arithmetically determined by using the correcting values in accordance with the following expression:

$$T_i=(1+K_A-K_D+K_{FUL})\times T_P+T_B \quad (7)$$

The time $T_B$ is generally referred to as the dead time which is determined on the basis of the operation characteristics of the injector. Upon completed execution of the step 1795, the program proceeds to steps 1801 and so forth shown in FIG. 18.

FIG. 18 shows in a flow chart a procedure for integrating the estimated intake air flow through steps 1801 to 1804.

At the step 1801, decision is made as to whether the timer memory $T_{AC}$ is zero or not. Unless the timer memory $T_{AC}$ is zero, this means that the program for updating the learned value after the detection of acceleration is being executed. In this case, the integrated value of the estimated intake air flow determined up to the preceding sampling time point is added with the estimated intake air flow determined at the instant sampling time point to thereby update the integrated value of the intake air flow at the step 1802, whereupon this program comes to an end. When it is decided at the step 1801 that the timer memory content $T_{AC}$ is zero, decision is then made at the step 1803 as to whether the timer memory content $T_{DEC}$ is zero or not. Unless $T_{DEC}$ is zero, this means that the program for updating the learned value after detection of deceleration is being executed. Accordingly, the integrated value $I_{Q'aD}$ is updated at the step 1803, whereupon the program comes to an end. In case the timer memory contents $T_{AC}$ and $T_{DEC}$ are both zero, the program is ended without performing integration.

As will now be appreciated from the foregoing description, the present invention teaches that difference between the actual air-fuel ratio and the reference value is determined within a predetermined time in succession to the detection of the transient state (acceleration or deceleration), wherein the learned transient correcting coefficient is updated on the basis of the abovementioned difference. According to the teaching of the present invention, difference between the estimated fuel supply as determined arithmetically and the actual fuel supply is corrected, whereby variation in the air-fuel ratio upon occurrence of the transient can be suppressed to thereby ensure an improved controllability of the air-fuel ratio even in the transient phase as well as significant reduction of harmful components contained in the exhaust gas.

We claim:

1. An engine control apparatus for an internal combustion engine, comprising:

engine state detecting means for detecting states of said engine;

memory means for storing a fuel supply correcting value;

arithmetic means for determining arithmetically a fuel supply value on the basis of said engine state and said fuel supply correcting value;

first integrating means for integrating the fuel supply value;

second integrating means for integrating an intake air value;

updating means for updating said fuel supply correcting value on the basis of the output of said first integrating means and the output of said second integrating means; and fuel supply means for controlling the fuel supply to said engine on the basis of said fuel supply value.

2. An engine control apparatus for controlling an internal combustion engine, comprising:

a plurality of engine state detecting means for detecting states of said engine, including at least air-fuel ratio detecting means for detecting air-fuel ratio;

memory means for storing a fuel supply correcting value;

comparison means for comparing a value based on the output of said air-fuel ratio detecting means with a predetermined value;

updating means for updating said fuel supply correcting value on the basis of the resulting of comparison performed by said comparison means;

arithmetic means for determining arithmetically a fuel supply value on the basis of said engine state and said fuel supply correcting value; and fuel supply means for controlling the fuel supply to said engine on the basis of said fuel supply value;

wherein said control apparatus includes first integrating means for integrating the fuel supply value and second integrating means for integrating intake air flow, wherein said updating means updates the storage content of said memory means on the basis of the output of said first integrating means and the output of said second integrating means.

3. An engine control apparatus for controlling an internal combustion engine, comprising:

a plurality of engine state detecting means for detecting states of said engine, including at least air-fuel ratio detecting means for detecting air-fuel ratio;

memory means for storing a fuel supply correcting value;

comparison means for comparing a value based on the output of said air-fuel ratio detecting means with a predetermined value;

updating means for updating said fuel supply correcting value on the basis of the result of comparison performed by said comparison means;

arithmetic means for determining arithmetically a fuel supply value on the basis of said engine state and said fuel supply correcting value; and fuel supply means for controlling the fuel supply to said engine on the basis of said fuel supply value;

wherein said control apparatus includes first integrating means for integrating the fuel supply value, second integrating means for integrating the intake air flow, theoretical fuel supply determination means for determining a theoretical fuel supply value on the basis of the output of said second integrating means and a desired air-fuel ratio, and second comparison means for comparing the output of said first integrating means with the output of said theoretical fuel supply determination means, wherein said updating means updates the storage content of said memory means on the basis of the output of said comparison means while updating the storage content of said memory means on the basis of the output of said second comparison means.

4. An engine control apparatus for controlling an internal combustion engine, comprising:

a plurality of engine state detecting means for detecting states of said engine, including at least air-fuel ratio detecting means for detecting air-fuel ratio;

memory means for storing a fuel supply correcting value;

comparison means for comparing a value based on the output of said air-fuel ratio detecting means with a predetermined value;

updating means for updating said fuel supply correcting value on the basis of the result of comparison performed by said comparison means;

arithmetic means for determining arithmetically a fuel supply value on the basis of said engine state and said fuel supply correcting value; and fuel supply means for controlling the fuel supply to said engine on the basis of said fuel supply value;

said control apparatus including means for detecting acceleration and deceleration of said engine and instantaneous memory means for effecting arithmetic determination of the fuel supply value following detection of acceleration of said engine, wherein said arithmetic means includes means for determining arithmetically the fuel supply value on the basis of the content placed in said instantaneous memory means immediately after the accelerating state of said engine is detected.

5. An engine control apparatus according to claim 4, said instantaneous memory means including acceleration-destined memory means for effecting arithmetic determination of the fuel supply value following detection of acceleration of said engine, and including deceleration-destined memory means for effecting arithmetic determination of the fuel supply value following detection of deceleration of said engine, wherein said ;arithmetic means includes means for determining arithmetically the fuel supply value on the basis of the content of said acceleration-destined memory means upon detection of acceleration of said engine while determining arithmetically said fuel supply value on the basis of the content of said deceleration-destined memory means upon detection of deceleration of said engine.

6. An engine control apparatus for controlling an internal combustion engine, comprising:

a plurality of engine state detecting means for detecting the state and various operating conditions of said engine, including at least one detector means for providing an output signal related to air-fuel ratio;

memory means for storing first fuel supply correcting values for use during acceleration from a no fuel cut condition and second fuel supply correcting values for use during acceleration from a fuel cut condition;

comparison means for comparing a value based on the output signal of said detector means with a predetermined value;

arithmetic means for determining arithmetically a fuel supply value on the basis of the engine state and one of said first and second fuel supply correcting values selected from said memory means on the basis of whether said engine is accelerating from a fuel cut condition or a no fuel cut condition; and fuel supply means for controlling the fuel supply to said engine on the basis of said fuel supply value;

7. An engine control apparatus according to claim 6, further including updating means for updating said first and second fuel supply correcting values on the basis of an output of said comparison means.

8. An engine control apparatus according to claim 6, wherein said memory means also stores a plurality of learned transient value correcting coefficients, and further including updating means for updating said first and second fuel supply correcting values in said memory means on the basis of learned transient value correcting coefficients selected according to an output of said comparison means.

9. An engine control apparatus according to claim 8, wherein said learned transient value correcting coefficients are stored as a map according to different values of change in airfuel ratio.

10. An engine control apparatus for controlling an internal combustion engine, comprising:

a plurality of engine state detecting means for detecting the state and various operating conditions of said engine, including at least one detector means for providing an output signal related to air-fuel ratio;

memory means for storing first fuel supply correcting values for use during acceleration;

comparison means for comparing a value based on the output signal of said detector means with a predetermined value;

arithmetic means for periodically determining arithmetically a basic fuel supply value on the basis of the engine state and for determining a compensated fuel supply value on the basis of said basic fuel supply value and a fuel supply correcting value selected from said memory means;

fuel supply means for controlling the fuel supply to said engine on the basis of said compensated fuel supply value; and updating means for updating said fuel supply correcting values in said memory means on the basis of a learned transient value correction coefficient based on the actual fuel amount supplied to the engine and a detected air flow amount.

11. An engine control apparatus according to claim 10, wherein said memory means stores first fuel supply correcting values for use during acceleration from a no fuel cut condition and second fuel supply correcting values for use during acceleration from a fuel cut condition, and said arithmetic means selects from said first or said second fuel supply correcting values, depending on whether the engine is accelerating from a no fuel cut condition or a fuel cut condition, determining said compensated fuel supply value.

12. An engine control apparatus for controlling an internal combustion engine, comprising:

a plurality of engine state detecting means for detecting the state and various operating conditions of said engine, including at least one detector means for providing an output signal related to air-fuel ratio;

memory means for storing first fuel supply correcting values for use during deceleration;

comparison means for comparing a value based on the output signal of said detector means with a predetermined value;

arithmetic means for periodically determining arithmetically a basic fuel supply value on the basis of the engine state and for determining a compensated fuel supply value on the basis of said basic fuel supply value and a fuel supply correcting value selected from said memory means;

fuel supply means for controlling the fuel supply to said engine on the basis of said compensated fuel supply value; and updating means for said fuel supply correcting values in said memory means on the basis of a learned transient value correction coefficient based on the actual fuel amount supplied to the engine and a detected air flow amount.

* * * * *